US007178310B2

(12) United States Patent
Veselovsky et al.

(10) Patent No.: US 7,178,310 B2
(45) Date of Patent: Feb. 20, 2007

(54) POLY-STRETCH BAGGER SYSTEM WITH HOCKING PUSHER

(75) Inventors: Oleg Veselovsky, Glenview, IL (US); Robert Pinto, Chicago, IL (US); Eggo L. Haschke, Deerfield, IL (US); Edward D. Kirk, Mundelein, IL (US)

(73) Assignee: Poly-Clip System Corp., Mundelein, IL (US)

( * ) Notice: Subject to any disclaimer, the term of this patent is extended or adjusted under 35 U.S.C. 154(b) by 38 days.

(21) Appl. No.: 11/080,869

(22) Filed: Mar. 15, 2005

(65) Prior Publication Data

US 2005/0155330 A1 Jul. 21, 2005

Related U.S. Application Data

(63) Continuation-in-part of application No. 10/435,912, filed on May 12, 2003, now Pat. No. 6,895,726, which is a continuation of application No. 10/046,143, filed on Jan. 15, 2002, now abandoned.

(60) Provisional application No. 60/261,969, filed on Jan. 16, 2001.

(51) Int. Cl.
*B65B 43/28* (2006.01)

(52) U.S. Cl. ..... 53/384.1; 53/459; 53/469; 53/556

(58) Field of Classification Search ..... 53/459, 53/469, 529, 570, 571, 573, 258, 556, 384.1; 493/218, 255, 258
See application file for complete search history.

(56) References Cited

U.S. PATENT DOCUMENTS

| | | | | |
|---|---|---|---|---|
| 3,254,472 | A * | 6/1966 | Clark et al. | 53/259 |
| 4,069,643 | A * | 1/1978 | Young et al. | 53/434 |
| 4,241,562 | A | 12/1980 | Meyer | |
| 4,270,336 | A | 6/1981 | Altenpohl et al. | |
| 4,464,882 | A * | 8/1984 | Van Ginkel et al. | 53/530 |
| 5,209,043 | A * | 5/1993 | Kupcikevicius | 53/434 |
| 5,435,114 | A * | 7/1995 | Moehlenbrock et al. | 53/434 |
| 5,692,360 | A | 12/1997 | McDonald et al. | |

* cited by examiner

*Primary Examiner*—Hemant M. Desai
(74) *Attorney, Agent, or Firm*—Trexler, Bushnell, Giangiorgi, Blackstone & Marr, Ltd.

(57) ABSTRACT

A bagger system for enclosing poultry very tightly in a plastic bag, to reduce material costs, present a pleasing appearance, decrease leaks, and minimize distortion of the printed information on the bag. A grabber assembly is described, to grasp the legs of the poultry and guide the poultry into a bag in proper hocking position.

5 Claims, 11 Drawing Sheets

POLY-STRETCH BAGGER SYSTEM WITH HOCKING PUSHER

CROSS REFERENCE

This patent application in a continuation-in-part of U.S. patent application Ser. No. 10/435,912, filed May 12, 2003 now U.S. Pat. No. 6,895,726, issued on May 24, 2005 which was a continuation of U.S. patent application Ser. No. 10/046,143 filed Jan. 15, 2002 now abandoned, which claims the benefit of U.S. Provisional Patent Application No. 60/261,969, filed Jan. 16, 2001.

BACKGROUND OF THE INVENTION

This invention is generally directed to a system for encasing materials, such as poultry or other materials, in plastic bags. The poultry industry sells fowl either as whole dressed birds or as cut-up parts. A consumer can buy a whole dressed chicken, can buy one dressed chicken cut up into parts, or can buy a package of, for example, just legs or just wings. In the two latter situations, the chicken parts are placed on a disposable tray, typically styrofoam, in order to hold the parts together. Some poultry producers place whole dressed birds on these trays also.

The prior art method to encase the product is a heat-seal process. The tray and product are wrapped in a clear plastic material which is then exposed to heat, shrinking the wrapping material and sealing the package. The advantage to the heat-sealing process is that it wraps the product very tightly. In the case of products such as poultry, a tighter package presents a better appearance to consumers. There is an increased marketing advantage to more tightly wrapped packages. Accordingly, the tighter the package can be wrapped, the more advantageous the system.

The disadvantage to the heat-sealing system is that the heat-sealed packages tend to leak. The packaging for any material encased by this method that has any liquid will, sooner or later, leak that liquid. "Leakers" are a problem both for the sellers such as grocery stores and for consumers, as the leaked fluid must be cleaned from the display case, refrigerator, or anywhere else it spilled. Chicken blood in particular is a problem, as it may contain bacteria and must be cleaned quite thoroughly.

A solution to the leaking problem is to use plastic bags to encase the products. A plastic bag that is clipped provides a better sealed package than one subjected to the heat-sealing process. Clipped bags are accordingly less likely to leak.

It is difficult, however, to place an object, such as a chicken, in a bag the exact same size as the chicken. Using a bag larger than the chicken eases the bagging process. The larger bag detracts from the appearance of the package, however, as the chicken is not tightly wrapped. There is also an increased cost to using larger bags.

It is also difficult to place a tray containing a chicken into a bag, since the parts must remain upright until securely wrapped. It is also mechanically difficult to place material on a tray into a bag and also maintain a tight fit, because of the relatively rigid structure of the tray. The use of a larger bag eases the process of placing the loaded tray into the bag, but the material on the tray will then likely fall off the tray later, such as during loading or in transit, defeating the whole purpose of using a tray. Accordingly, trayed chicken, whether whole or cut-up parts, is generally not bagged in the poultry industry.

Additionally, there is a manufacturing and marketing advantage to wrapping a whole chicken in a properly hocked position. A hocked chicken has the thighs of the legs held in close proximity to the sides of the carcass of the chicken. However, the legs of chickens tend to stick outward, up and away from the body, after slaughter. This position makes it difficult to encase a chicken, especially in a bag, and presents an unpleasing appearance to consumers. Consumers looking at a raw chicken in a grocery case will tend to respond more favorably to a chicken wrapped in a hocked position, as opposed to a chicken wrapped in an unhocked position.

Various methods have been used in the prior art to hold the legs of a chicken in a hocked position for presentation to consumers. Traditionally, of course, the legs were tied together with string. Other devices have been described. For example, U.S. Pat. No. 4,293,977, Poultry Trussing Device, describes the use of a bent wire device to hold the legs together. U.S. Pat. No. 5,279,519, Chicken Hock Device, describes the use of a plastic device to hold the legs together. These solutions add another step to the process, and accordingly increase the capital, labor, and material costs of encasing a chicken for market.

Additionally, marketers of products usually wish to display their trade names, trade dress, or logos on the packaging. Marketers sometimes also wish to display other information, such as warnings or instructions, on the packaging. It is less expensive to preprint the packaging material. Adding one or more labels after packing adds an extra cost. Printing directly onto the package after packing is very expensive. Accordingly, the use of preprinted packaging material is desired. Forcing a chicken or a tray of chicken parts into a very tight plastic bag, however, causes random distortion of the printing on the bag, disfiguring the preprinted information. Similarly, the heat-sealing process described above causes severe distortion of any printed information on the wrapping material.

Consequently, for heat-sealed packages, one or more separate labels must be used for any information such as brand identification or cooking instructions. This placement of separate labels, of course, adds an additional cost.

One method presently known to the poultry industry to preprint information on the packaging of whole dressed chickens is to use bags slightly larger than the average chicken. As described above, however, the use of larger bags presents a less appealing appearance to consumers and increases material costs.

A method presently known to encase a chicken in a very tight bag without distortion of the printed material is to shrink the bag with heat after the chicken is in the bag. This method requires specialized, expensive wrapping material.

Accordingly, there is a need for an apparatus and method of encasing material such as poultry, including whole dressed birds and whole dressed birds on trays, in a properly hocked position, in order to provide a pleasing appearance to consumers and to ease the process of putting the bird into a bag. Additionally, there is a need for an apparatus and method of encasing material such as poultry, including whole dressed birds and whole dressed birds on trays, in tightly wrapped bags, in order to provide a pleasing appearance to consumers, to prevent "leakers", to lower costs, and to provide and maintain printing on the packaging. The present invention meets these needs.

SUMMARY OF THE INVENTION

A general object of the present invention is to provide a method and apparatus for encasing poultry in a properly hocked position, tightly in plastic bags, in order to present a more pleasing appearance to consumers.

Another object of the present invention is to minimize the amount of packaging material needed to encase poultry in a properly hocked position in plastic bags.

Another object of the present invention is to minimize the cost of packaging material for encasing properly hocked poultry.

Briefly, and in accordance with the foregoing, the present invention discloses an apparatus and a method to stretch a plastic bag, grasp poultry such as a whole chicken or a whole chicken on a tray, by the legs, push the poultry into the bag while maintaining the legs in a properly hocked position, and eject the material and bag from the apparatus for clipping to seal the bag. The pusher assembly of the present invention, by maintaining the poultry in a properly hocked position, allows the use of smaller bags, by reducing the cross-section of the poultry as it is pushed into the bag. The apparatus and method of stretching the bag before inserting the chicken allow the bag to contract around the material and therefore encase the material very tightly. The use of a plastic bag with a clip closure provides for a very tight seal. Finally, the use of plastic bags with a memory agent allows the plastic to expand and then contract around the material very tightly and very evenly Because the bags contain a memory agent and are stretched evenly, they will contract back around the material with minimal distortion of the printed information on the bag.

BRIEF DESCRIPTION OF THE SEVERAL VIEWS OF THE DRAWINGS

The organization and manner of the structure and operation of the invention, together with further objects and advantages thereof, may best be understood by reference to the following description, taken in connection with the accompanying drawings.

DETAILED DESCRIPTION OF THE PREFERRED EMBODIMENT OF THE INVENTION

Figure 1:
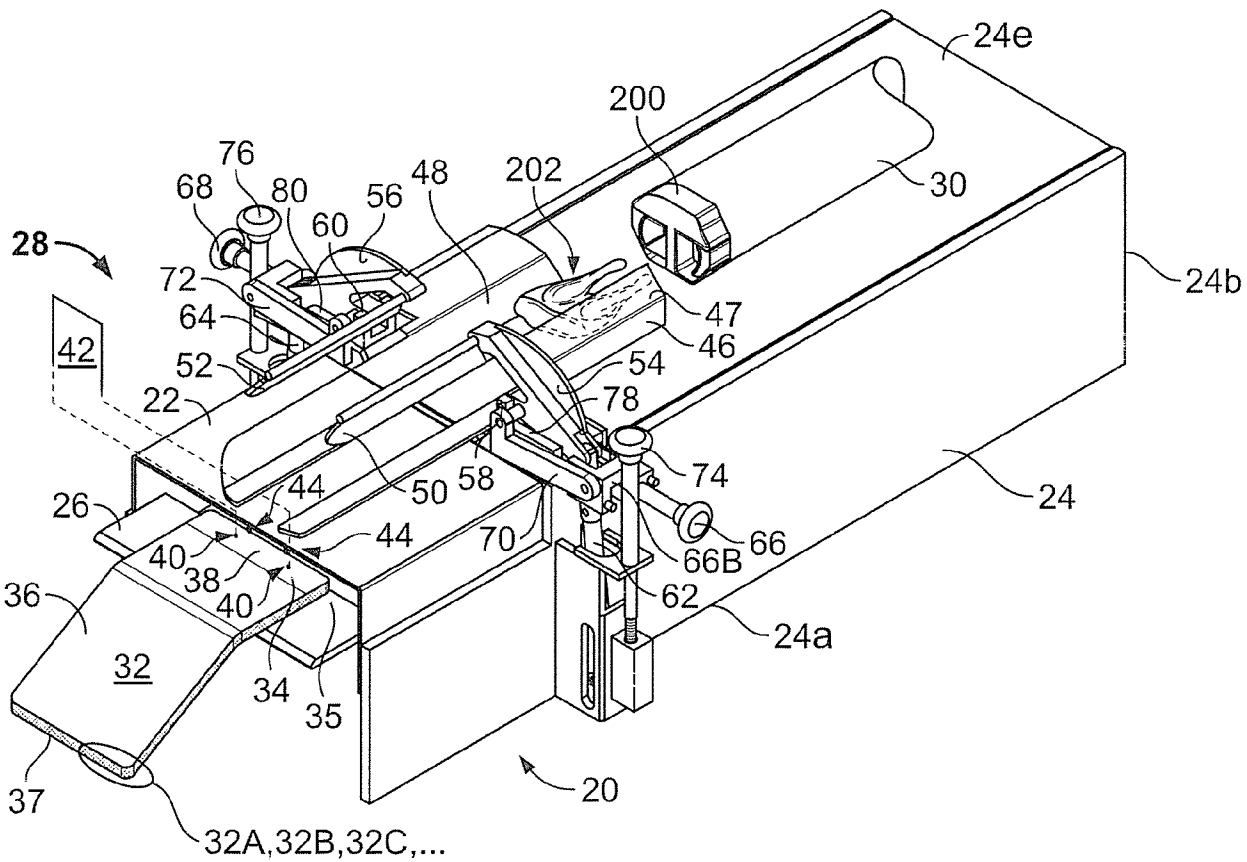
FIG. 1 is a perspective view of the bagger apparatus of the preferred embodiment of the present invention.

While the invention may be susceptible to embodiments in different forms, there is shown in the drawings, and herein will be described in detail, a specific embodiment with the understanding that the present disclosure is to be considered an exemplification of the principles of the invention, and is not intended to limit the invention to that as illustrated and described herein. For example, the present disclosure describes the method and apparatus as used to encase chickens and chicken parts, but the same method and apparatus can be used for other poultry and for other material without departure from the invention.

Figure 2:
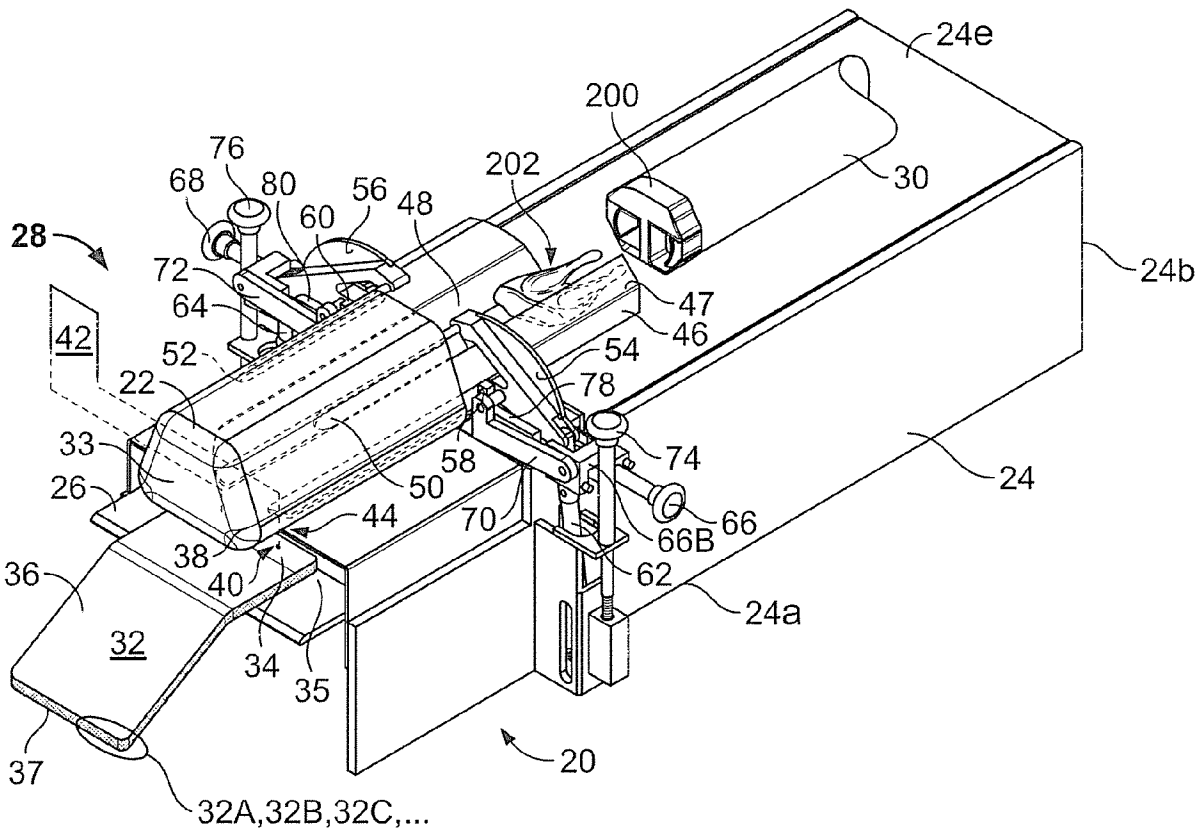
FIG. 2 is a perspective view of the bagger apparatus of the preferred embodiment of the present invention, showing a bag stretched and ready to receive material.

A perspective view of an apparatus 20 is shown in FIGS. 1 and 2. The apparatus 20 includes a rigid frame 24 having a front 24*a*, a rear 24*b*, a left side 24*c*, a right side 24*d*, and a top 24*e*. Please note that in the preferred embodiment, the rigid frame 24 as well as all other components of the apparatus 20 are made of stainless steel for ease of cleaning, but any material can be used.

A bag carriage 22 is located at the rear of the rigid frame 24. The bag carriage 22 is shaped, in cross-section, like an inverted "U". It has a flat horizontal surface 22*a*, and two sides 22*b* and 22*c* extending downward. The sides 22*b* and 22*c* ride on rails (not shown) on the inside of the rigid frame 24, but any means of attachment can be used, so that the bag carriage 22 slides inside the rigid frame 24 from the rear 24*b* towards the front 24*a* and back again. Additionally, the bag carriage 22 has two air jets 44 located under its horizontal surface and facing to the rear of the rigid frame 24. These air jets 44 are connected to a standard compressed air supply (not shown).

The bag carriage 22 preferably includes a bag platform 26. The bag platform 26 is generally rectangular in shape and is mounted so that the rear edge of the bag platform 26 is positioned under the horizontal surface 22*a* of the bag carriage 22. The bag platform 26 is attached to the bag carriage 22 by any suitable means (not shown) so that the bag platform 26 travels front 24*a* to rear 24*b* along with the bag carriage 22. Additionally, however, the bag platform 26 has means, not shown, to raise it and lower it independently between its first, lower position and a second, raised position. Any suitable hydraulic or mechanical system can be used to accomplish this raising and lowering. The upward movement of the bag platform 26 is stopped by the airjets 44 located at the underside of the horizontal surface 22*a* of the bag carriage 22. The bag platform 26 includes two apertures, not shown, in its flat horizontal surface for attaching a stack of bags 32.

As shown in FIG. 1, a stack of bags 32 includes bags 32A, 32B, 32C, etc. Each bag 32A, 32B, 32C, etc. includes a bottom 34, a top 36, a front end 35 and a rear end 37. The bottom extends beyond the top 36, creating an opening 38. Two apertures 40 are provided through the bottom 34 near the front end 35 of the bags 32A, 32B, 32C, etc. When the stack of bags 32 is place on the bag platform 26, the apertures 40 in the stack of bags 32 align with the apertures in the bag platform 26. An inverted unshaped wicket 42 is provided for mounting the stack of bags 32 on the bag platform 26. The stack of bags 32 is mounted to the bag platform 26 by passing the ends of the wicket through the apertures 40 and through the apertures in the bag platform 26 and then securing the ends of the wicket 42 under the bag platform 26, such as by twisting the ends of the wicket together, bolting the ends, or any other suitable method of attaching the wicket 42 to the bag platform 26.

A bag-stretching unit 28 has left-side and right-side components, including a left base guide 46, a right base guide 48, a left finger 50, a right finger 52, a left arm 54, and a right arm 56. The relation of the left and right components to each other and to the rigid frame 24 can be adjusted.

As shown in FIGS. 1 and 3, a left sizer 66 includes a left screw adjuster 66A, a left sizer mount 66B, and a left bracket 70. The left screw adjuster 66A is connected to the rigid frame 24, so that rotation of the left screw adjuster 66A causes it to move toward the left 24*c* or the right 24*d* relative to the rigid frame 24. The left sizer mount 66B is connected to the left screw adjuster 66A so that the left screw adjuster 66A rotates within the left sizer mount 66B, but moves the left sizer mount 66B toward the left 24*c* or the right 24*d* of the rigid frame 24 as the left screw adjuster 66A moves. The left sizer mount 66B is attached to the left bracket 70, which is connected to a left arm 54. The left arm 54 is adjusted toward the left 24*c* or the right 24 of the rigid frame 24 as hereinafter described, by rotation of the left screw adjuster 66A.

Similarly, a right sizer 68 includes a right screw adjuster 68A, a right sizer mount 68B, and a right bracket 72. The right screw adjuster 68A is connected to the rigid frame 24, so that rotation of the right screw adjuster 68A causes it to move toward the left 24*c* or the right 24*d* relative to the rigid frame 24. The right sizer mount 68B is connected to the right screw adjuster 68A so that the right screw adjuster 68A rotates within the right sizer mount 68B, but moves the right sizer mount 68B toward the left 24*c* or the right 24*d* of the rigid frame 24 as the right screw adjuster 66A moves. The right sizer mount 68B is attached to the right bracket 72, which is connected to a right arm 56. The right arm 56 is adjusted toward the left 24*c* or the right 24 of the rigid frame 24 as hereinafter described, by rotation of the right screw adjuster 68A.

In the preferred embodiment, the adjustable sizers 66 and 68 are screw-type adjusters. However, any kind of adjusting mechanism can be used to adjust the distance between the left arm 54 and the right arm 56. In the preferred embodiment the user can adjust the distance, grossly or finely, between the right arm 56 and the left arm 54 to allow for differences in sizes of trays, variations in sizes of bags, variations in sizes of material to be bagged and variations in stretchability of bags from different vendors or suppliers.

A left height adjuster 74 is connected to the frame 24 and to the left piston 62. A right height adjuster 76 is connected to the frame 24 and to the right piston 64. The height of the left piston 62 is adjusted by rotating the left height adjuster 74 and the height of the right piston 64 is adjusted by rotating the right height adjuster 76. By adjusting the height of the left piston 62, which articulates with the left arm 54, the user can adjust the degrees of arc through which the left arm 54 travels, thereby adjusting the height to which the left finger 50 will reach. Similarly, by adjusting the height of the right piston 64, which articulates with the right arm 56, the user can adjust the degrees of arc through which the right arm 56 travels, thereby adjusting the height to which the right finger 52 will reach. In the preferred embodiment, the left and right height adjusters 74, 76 are screw-type adjusters but any type of height adjustment can be done without departing from the spirit of the invention.

The left arm 54 connects to a left mounting bracket 78, and rotates about a left axle 58. The left mounting bracket 78 is connected to the frame 24. Similarly the right arm 56 connects to a right mounting bracket 80, and rotates about a right axle 60. The right mounting bracket 80 is connected to the frame 24.

Figure 3A:
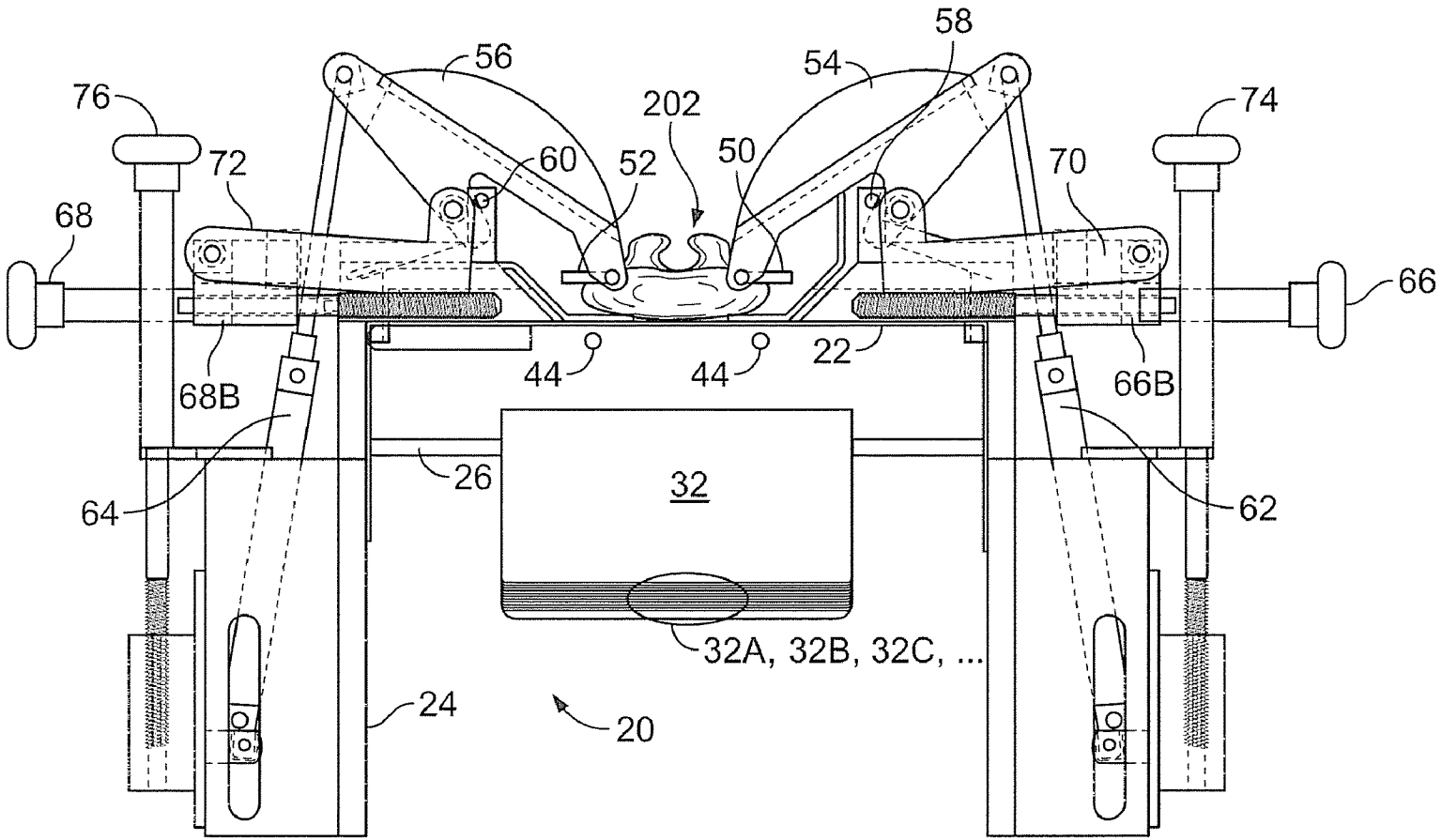
FIG. 3A is an elevation view of the bagger apparatus of the preferred embodiment of the present invention, showing the arms of the bag-stretching unit in a first position.
Figure 3B:
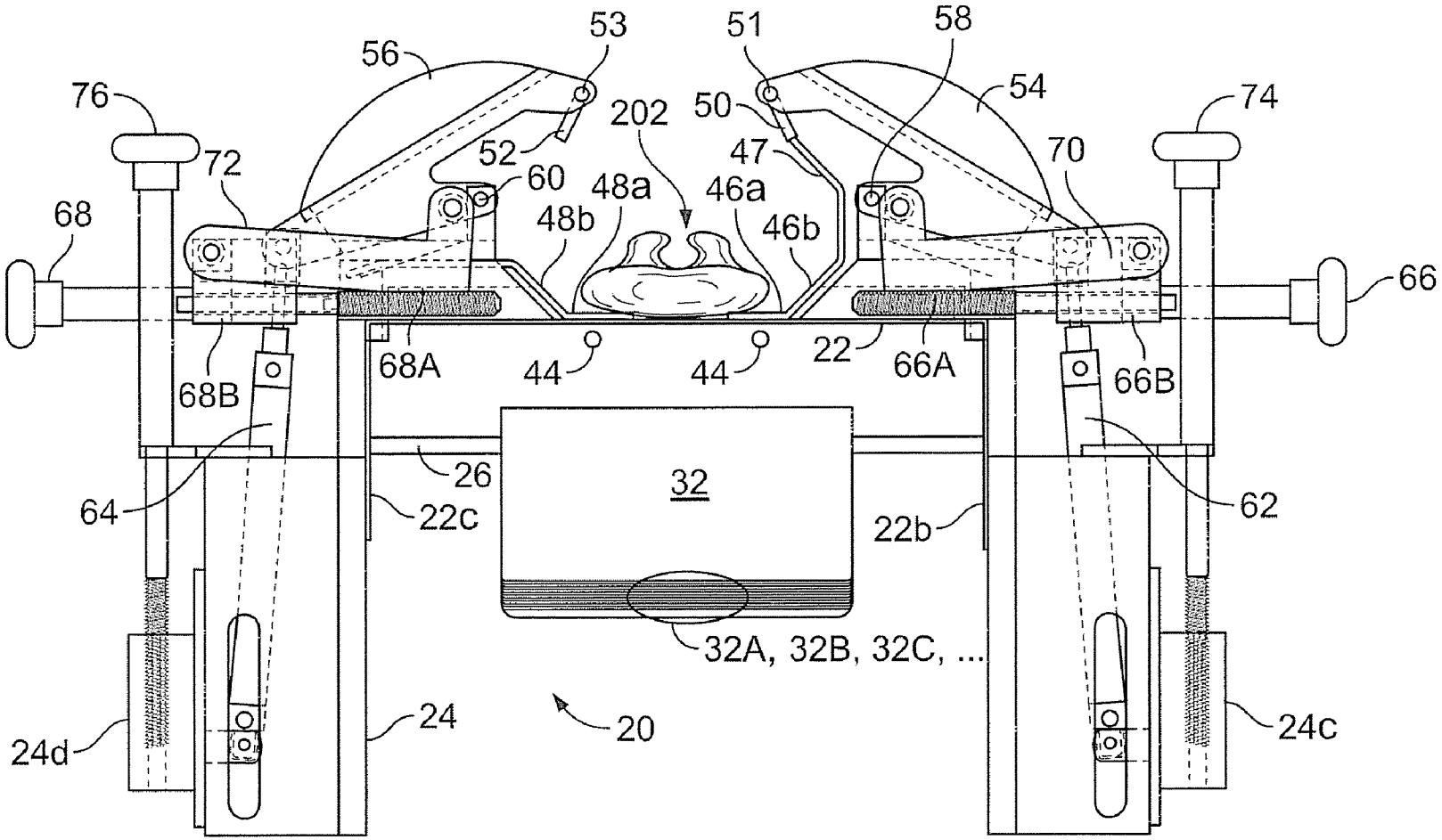
FIG. 3B is an elevation view of the bagger apparatus of the preferred embodiment of the present invention, showing the arms of the bag-stretching unit in a second position.

The left adjustable base guide 46 is an elongated member, with an angled cross-section. The left adjustable base guide 46 is positioned above the frame 24, is essentially parallel to the top surface of the frame 24, and extends from near the front of the frame 24 to beyond the rear of the frame 24. As shown in FIGS. 3A and 3B, the base guide 46 includes a lower portion 46*a* and an upper portion 46*b*. The upper portion 46*b* slants upward and outward toward the left 24*c* of the frame 24. The left adjustable base guide 46 also includes a stopping plate 47. The stopping plate 47 includes a lower portion 47*a* and an upper portion 47*b*. The lower portion 47*a* extends upward from the left adjustable base guide 46. The upper portion 47*b* extends upward and inward from the lower portion 47*a*. The stopping plate 47 extends along a portion of the left adjustable base guide 46.

The right adjustable base guide 48 is an elongated member, with an angled cross-section. The right adjustable base guide 48 is positioned above the frame 24, is essentially parallel to the top surface of the frame 24, and extends from near the front of the frame 24 to beyond the rear of the frame 24. As shown in FIGS. 3A and 3B, the base guide 48 includes a lower portion 48*a* and an upper portion 48*b*. The upper portion slants upward and outward toward the right 24*d* of the frame 24.

All edges of both the left adjustable base guide 46 and the right adjustable base guide 48 are rounded to allow plastic to slide over those edges. Additionally, the rear ends of the base guides 46 and 48 are tapered for the same purpose.

A left finger 50 is pivotally attached to the left arm 54 through a rod 51. A right finger 52 is pivotally attached to the right arm 56 through a rod 53. The left finger 50 and the right finger 52 are elongated members that extend rearward of the left arm 54 and the right arm 56, respectively. Each finger 50, 52 is generally rectangular in cross-section. The edges of each finger 50, 52, however, are rounded to allow plastic to slide over those edges more easily. Additionally, the round rods 51, 53 provide a rounded surface which will also contact the plastic during the stretching process to be hereinafter described. Both fingers 50 and 52 are tapered at their rear ends.

Figure 4:
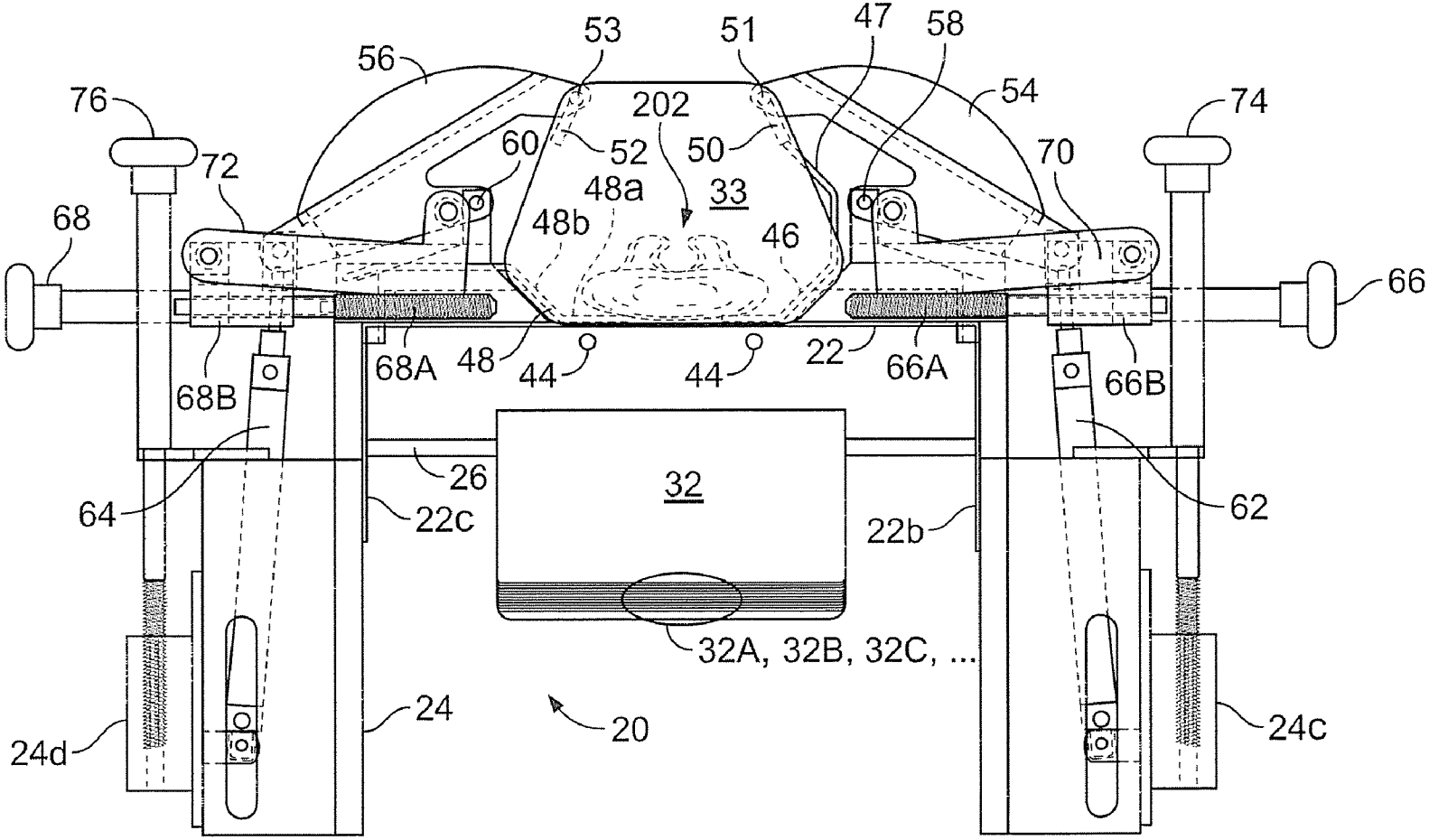
FIG. 4 is an elevation view of the bagger apparatus of the preferred embodiment of the present invention, showing the arms in a second position and a bag stretched and ready to receive material.
Figure 5:
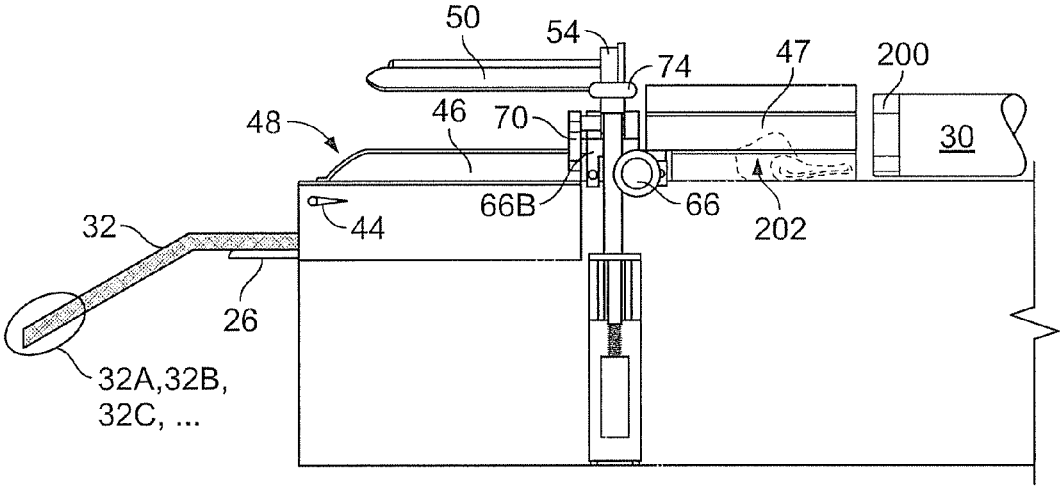
FIG. 5 is a side elevation view of the bagger apparatus of the preferred embodiment of the present invention, showing the arms in a second position.

The left finger 50 and right finger 52 are mounted on the mounting arms 54 and 56 so that the fingers 50 and 52 fit between the base guides 46, 48 when in a first position, as shown in FIG. 3A. When the mounting arms 54 and 56 rotate, as hereinafter described, the fingers 50 and 52 move upward and outward to a second position. In this second position, the flat sides of the fingers 50 and 52 point downward and outward toward the outer edges of the left and right adjustable base guides 46 and 48, respectively. Accordingly, as shown in FIGS. 2 and 4, the cross-section of the bag 32A, when it is stretched around the fingers 50, 52 and the base guides 46, 48, forms a hexagon which can be adjusted to approximate the cross-section of the material to be packaged, allowing for the use of a minimally-sized bag 32A and thereby saving material costs A ram 30 is positioned near the front of the apparatus 20. The ram 30 is aligned such that upon activation the ram will stroke forward between the base guides 46 and 48. The ram 30 is oriented so that it operates midway between the left adjustable base guide 46 and the right adjustable base guide 48. The ram 30, in the preferred embodiment, is an air piston with a forward and reverse stroke.

Operation of the apparatus will now be described. To begin the size of the bag to be packed is selected. The size of the bag to be used will be determined in part by the size of the item to be placed in the bag, and the ability of the bag to stretch. The size of the bag 32A is selected to form a very tight wrap around the material to be encased. In the preferred embodiment, a 7.25-inch bag forms a very tight wrap around a standard whole dressed chicken sold in the poultry industry. Different sized bags can be used for different sizes of poultry, different sizes of trays, or different material altogether. A stack of bags 32 of a preselected size is then loaded on the bag platform 26 using the wicket 42.

Next, the distance between the left base guide 46 and the right base guide 48 is adjusted using the left sizer 66 and the right sizer 68. The base guides 46, 48 are designed to accommodate either a tray or a whole bird. The angular cross-section allows a tray, containing either a whole bird or cut-up parts, to slide on and between the base guides 46, 48. The design of the guides also permits a whole bird to slide on and between the guides 46, 48. The height of the left and right arms 54, 56 is adjusted using the left and right height adjusters 74, 76, so that, when the arms 54, 56 are raised to a second position as hereinafter described, the fingers 50, 52 will be in a second position slightly above the height of the material to be packaged.

The arms 54, 56 begin in a first position. In this first position, the pistons 62, 64 are at extension, causing the arms 54, 56 to be rotated inward, causing the fingers 50, 52 to move downward and inward The bag carriage 22 begins in a first position in which the front 35 of the bag 32A is positioned slightly rearward of the base guides 46, 48. The bag platform 26 is raised from a first position to a second position. In the second position, the stack of bags 32 contacts the air jets 44 at the point of the opening 38 of the top-most bag 32A. At this point the top-most bag 32A is now at nearly the same height as the bag carriage 22. Air is forced through the jets 44 to lift the top of the first bag 32A above the left and right base guides 46, 48. Next the bag carriage 22 is moved forward, allowing the left base guide 46 and the right base guide 48 to pass over bottom 34 of the bag 32A and through the opening 38 of the bag 32A. As the bag carriage 22 moves, the top 36 of bag 32A slides over the left base guide 46, the right base guide 48, the left finger 50, and the right finger 52, the latter two of which are, at this time, in a first position wherein the left finger 50 and the right finger 52 are generally positioned between two base guides 46 and 48. The bag carriage 22 will continue to be moved forward to a second position until the base guides 46, 48 reach the rear end 37 of the bag 32A. Other devices, such as suction cups or a mechanical device, could also be used for opening the bag 32A.

Figure 6:
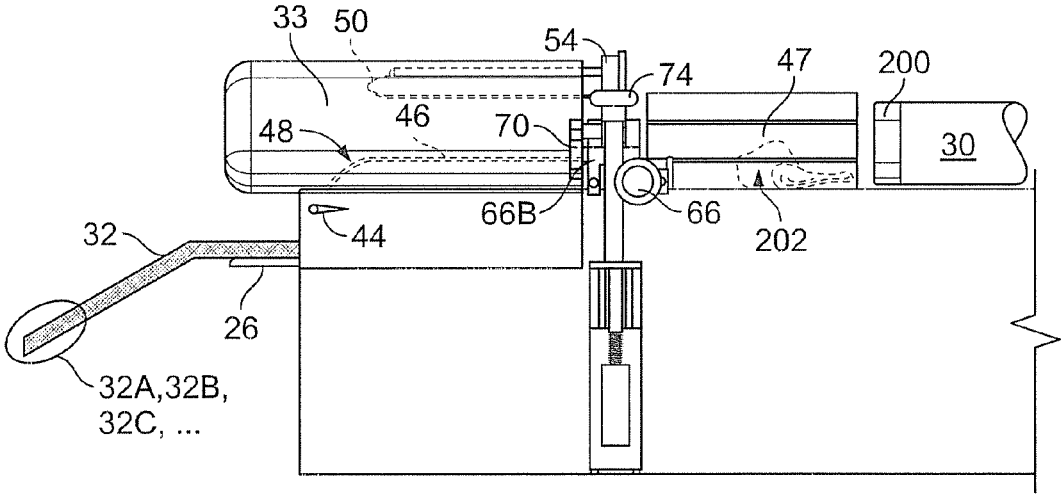
FIG. 6 is a side elevation view of the bagger apparatus of the preferred embodiment of the present invention, showing the arms in a second position and a bag stretched and ready to receive material.
Figure 7:
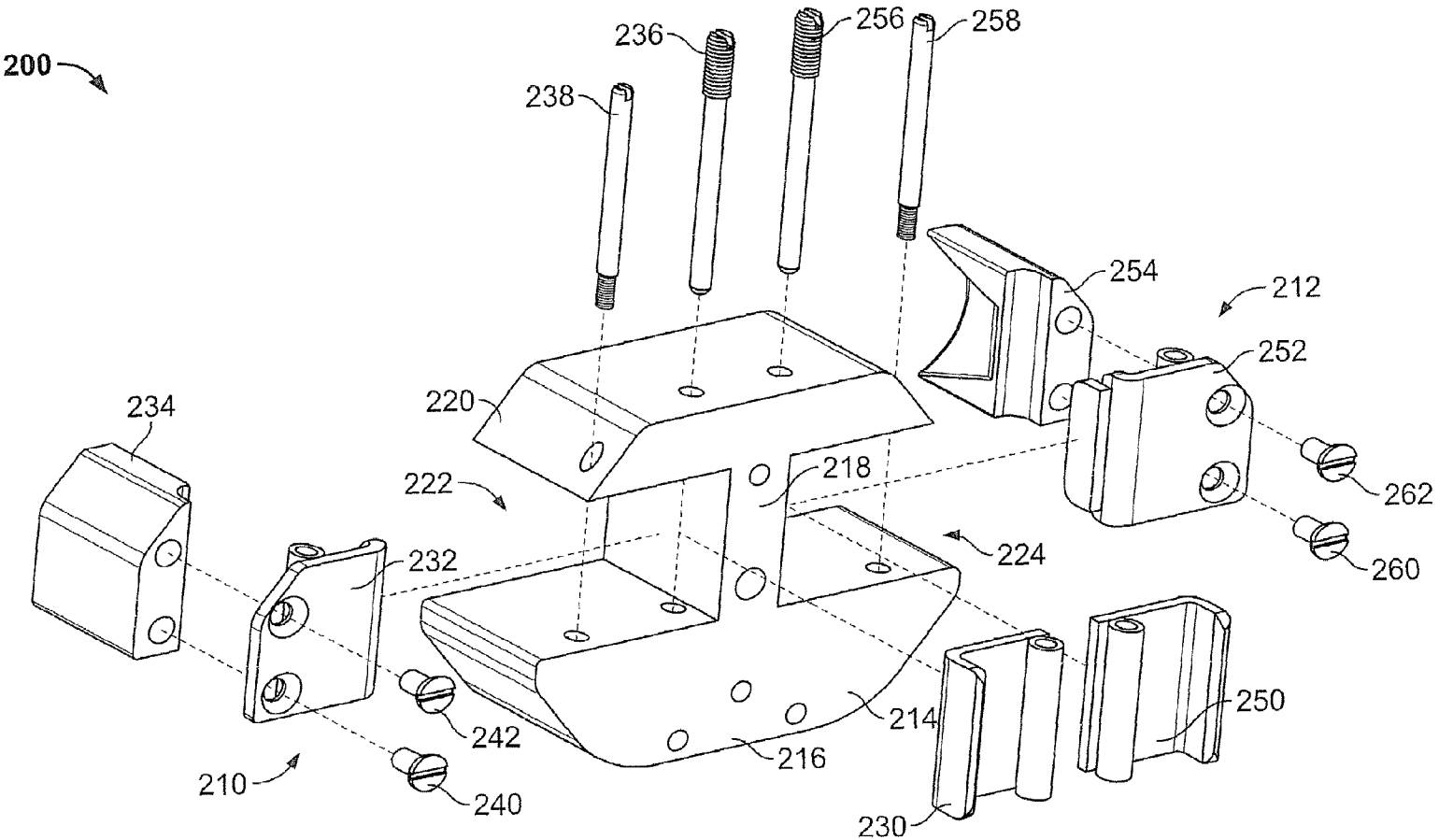
FIG. 7 is perspective, exploded view of the components of the pusher assembly of the preferred embodiment of the present invention.
Figure 8A:
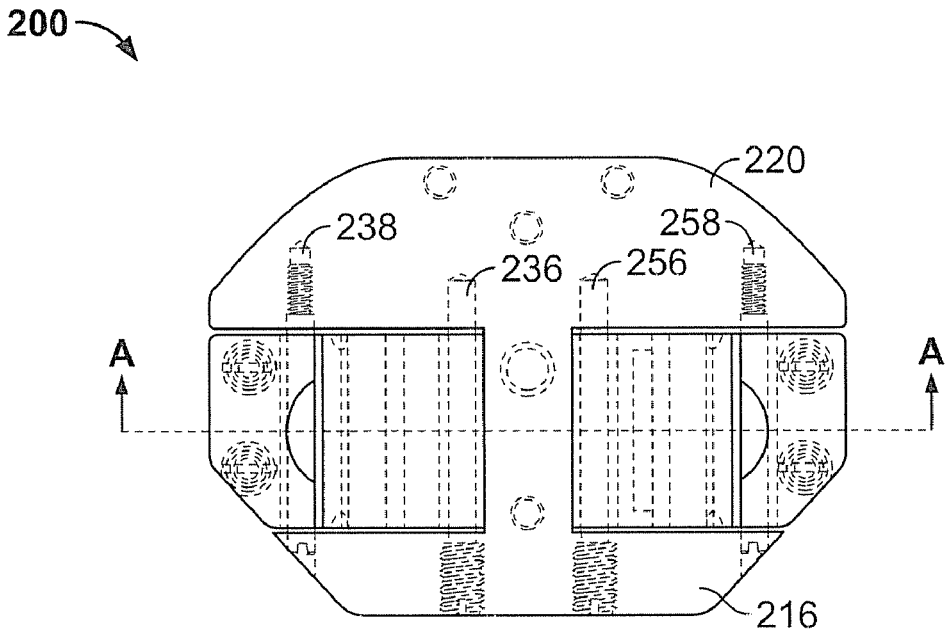
FIG. 8*a* is a top view of the pusher assembly of the preferred embodiment of the present invention, showing the components in a first, or open, position.
Figure 8B:
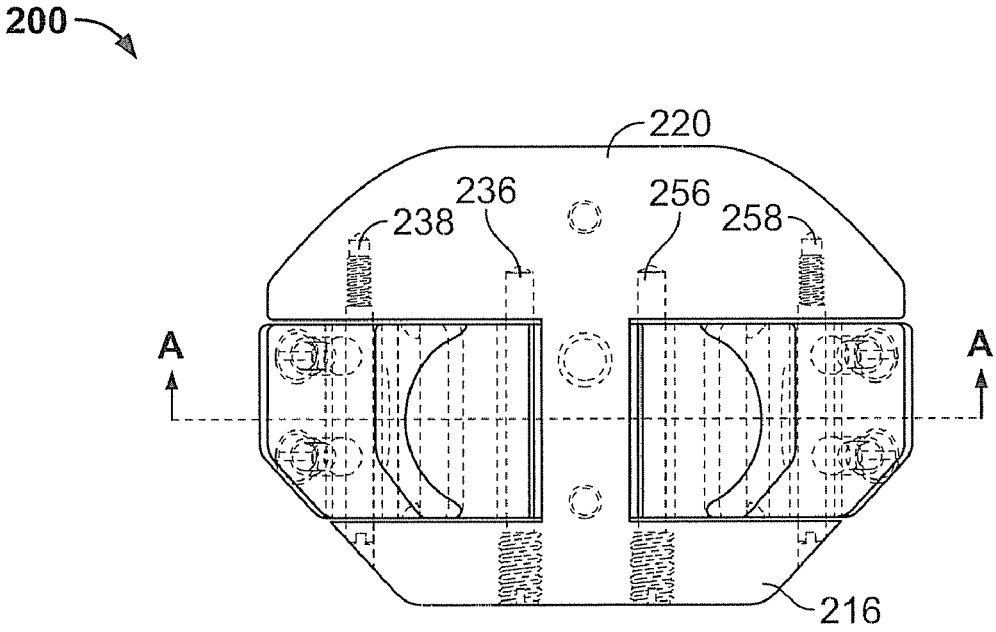
FIG. 8*b* is atop view of the pusher assembly of the preferred embodiment of the present invention, showing the components in a second, or closed, position

The pistons 62, 64 then retract to pull down on the arms 54, 56, causing the arms 54, 56 to rotate about their axles 58, 60. In turn, the fingers 50, 52 move upward and outward until the fingers 50, 52 reach a second position. The second position of the fingers 50, 52, which was preset as described above, was selected so that the fingers 50, 52 are positioned slightly above the top of the material to be packaged. The rotation of the arms 54, 56, by moving the fingers 50, 52 rotationally through arcs, causes the bag 32A to stretch evenly about its circumference. The bag 32A is now stretched and ready to receive material as shown in FIGS. 2, 4, and 6. At this point, the bag platform 26 drops a short distance to its first position, thereby tearing the now-stretched bag 32A off the wicket 42. What was the second bag 32B on the stack of bags 32 is now on top of the stack of bags 32. The bag carriage 22 returns to its first position, talking the bag platform 26 (still in its first position) along.

The item to be packed, for example, a whole dressed chicken or chicken parts on a tray, is placed on and between the base guides 46, 48. In the preferred embodiment, the item will be loaded from the right side of the apparatus. The stopping plate 47, mounted on the left side of the apparatus, will prevent the material from going over the edge of the left base guide 46. The apparatus 20 may be used as part of an automated system, for example, one in which trays of items are conveyed automatically to the location between the base guides 46 and 48. In the event that material is misguided by a user or a conveyor, and misses the intended area between the base guides 46, 48, the stopping plate 47 will retain the material and prevent it from going over the side of the base guide 46.

The ram 30 pushes the material into the now-stretched bag 32A. Continuation of the stroke of the ram 30 pushes the material and bag 32A off the base guides 46, 48 and the fingers 50, 52. As the bag 32A comes off the base guides 46, 48 and the stretching fingers 50, 52, the stretched plastic contracts back to its original size, and contracts around the material in the bag 32A. Because the plastic contains memory agent, the plastic will contract with minimal distortion of any printed information on the bag 32A. The contraction of the plastic will cause the bag 32A to wrap very tightly around the material, presenting the tight appearance that is pleasing to consumers and thereby conferring a marketing advantage upon products packaged by this method.

In the preferred embodiment, as the ram 30 pushes the now-encased material out the rear of the apparatus 20, it falls onto a conveyor belt (not shown), which carries the bagged material down the line for closure and clipping of the bag to form a tight seal. The now-encased material can be handled manually or by other mechanical methods.

When the bag carriage 22 moves horizontally to its original position, the bag support platform 26 also moves horizontally back to its original position also. The apparatus 20 is now ready for the next cycle. The ram then returns to its original position.

In the preferred embodiment, 7.25-inch bags can be used for standard whole birds instead of the 8.75-inch bags formerly used in the poultry industry, at a cost savings of approximately 15 percent. Because of the adjusting mechanisms, the apparatus 20 and method can be used for any size material with any suitably-sized bags.

The addition of a memory agent to polyethylene has been found to allow the plastic to expand in the stretching process and then to contract back around the encased material with minimal distortion. The use of polyethylene bags with three to six percent ethylene vinyl acetate (EVA) has been found to provide the best memory and therefore the least distortion of printed matter, but any suitable memory agent that meets this function will suffice.

The ram 30 of the present invention has a novel pusher assembly 200 attached to the front side of ram 30. Pusher assembly 200 is illustrated in FIGS. 7 through 11*b*. Pusher assembly 200 grabs a poultry, such as a chicken 202, that has been placed between base guides 46, 48 in order to guide chicken 202 into bag 32A and to ensure proper hocking of the legs 204, 206 of chicken 202. Because the chicken 202 is placed in the bag 32A in a properly hocked position, a smaller bag can be used, as the legs 204, 206 of the chicken 202 will not stick upwards and outwards. Additionally, the properly hocked chicken 202 will present a more pleasing appearance to consumers. The pusher assembly 200 will be described for use with a chicken, but can be used for any poultry, including but not limited to turkeys, pheasants and ducks.

As ram 30 makes a forward stroke and encounters a whole chicken 202, left grabber 210 and right grabber 212 grasp the legs 204, 206 and hold them in the proper hocking position until chicken 202 has been pushed completely into bag 32A. When ram 30 withdraws, grabbers 210, 212 automatically release legs 204, 206.

Pusher assembly 200 is make of a body 214 with a base portion 216, a connecting portion 218, and a top portion 220, which define a left slot 222 and a right slot 224.

Figure 9A:
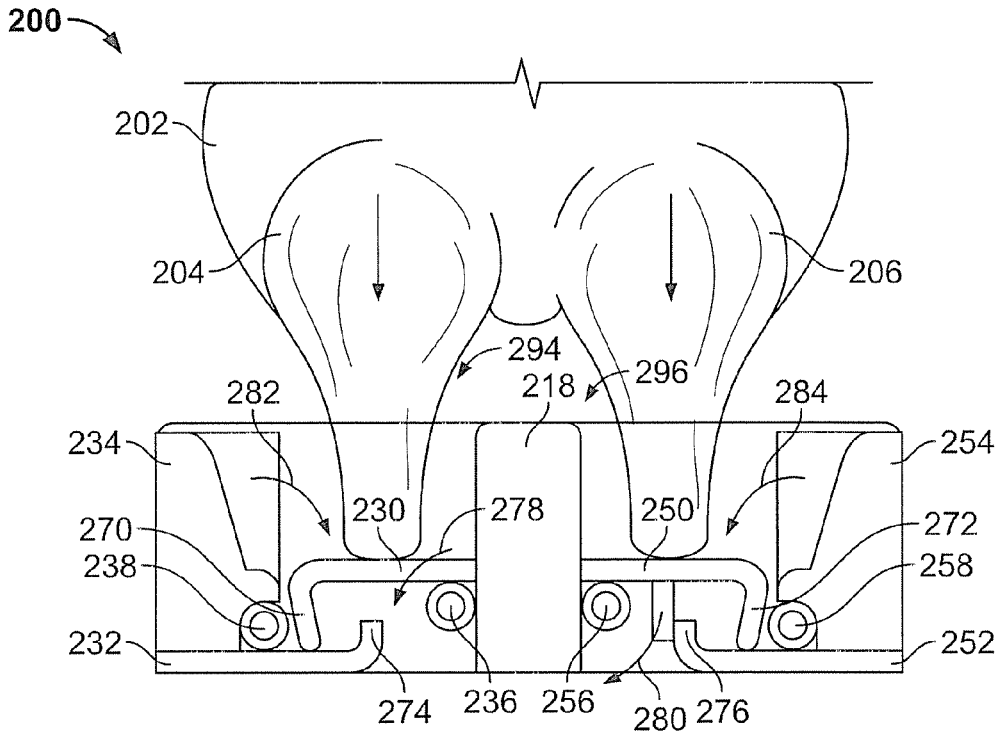
FIG. 9*a* is a sectional view of the pusher assembly of the preferred embodiment of the present invention, shown as section A—A of FIG. 8*a*, showing the components in a first, or open, position.
Figure 9B:
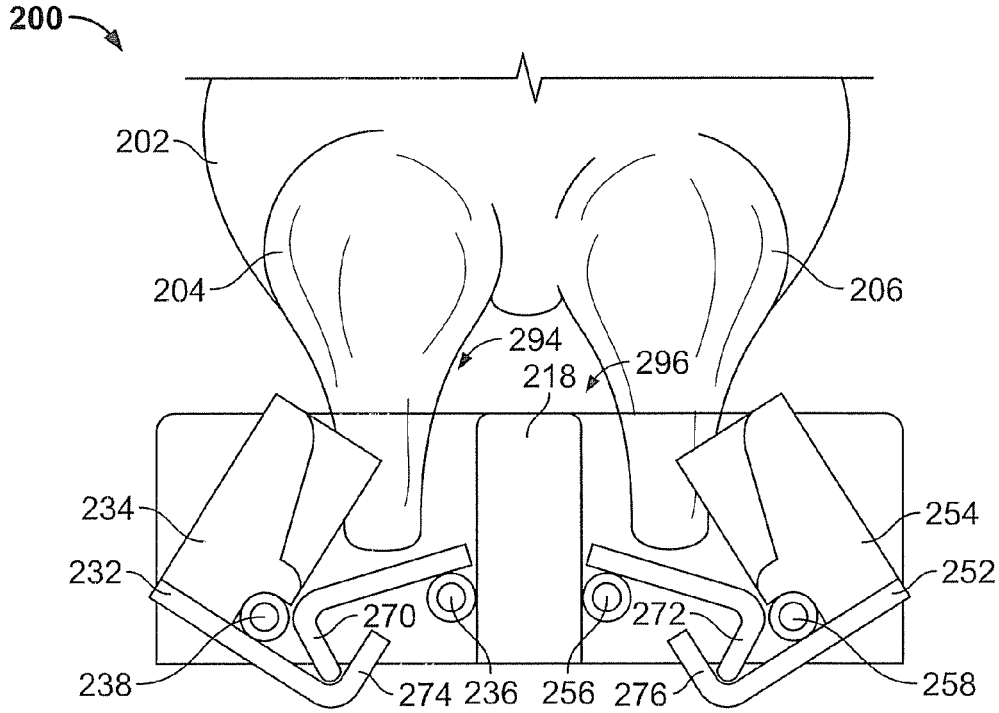
FIG. 9*b* is a sectional view of the pusher assembly of the preferred embodiment of the present invention, shown as section A—A of FIG. 8*a*, showing the components in a second, or closed, position.

Left grabber 210 is made of a left swing gate 230, a left swing plate 232, and a left clamp 234. A gate axle bolt 236 extending from top portion 220, through left slot 222, and into base portion 216 holds left swing gate 230 in left slot 222 and allows left swing gate 230 to rotate about gate axle bolt 236, from a first position as shown in FIG. 9*a*, to a second position as shown in FIG. 9*b*. A plate axle bolt 238 extending from top portion 220, through left slot 222, and into base portion 216 holds left swing plate 232 in left slot 222 and allows left swing plate 232 to rotate about plate axle bolt 238, from a first position as shown in FIG. 9*a*, to a second position as shown in FIG. 9*b*. A left clamp 234 is bolted to left swing gate 232 by screws 240, 242 or other suitable fasteners.

Right grabber 212, in mirror image to left grabber 210, is made of a right swing gate 250, a right swing plate 252, and a right clamp 254. A gate axle bolt 256 extending from top portion 220, through right slot 224, and into base portion 216 holds right swing gate 250 in right slot 224 and allows right swing gate 250 to rotate about gate axle bolt 256, from a first position as shown in FIG. 9*a*, to a second position as shown in FIG. 9*b*. A plate axle bolt 258 extending from top portion 220, through right slot 224, and into base portion 216 holds right swing plate 250 in right slot 224 and allows right swing plate 252 to rotate about plate axle bolt 258, from a first position as shown in FIG. 9*a*, to a second position as shown in FIG. 9*b*. A right clamp 254 is bolted to right swing gate 250 by screws 260, 262 or other suitable fasteners.

Both swing gates 230, 250 have extending shoulders 270, 272 respectively, that extend in the direction to the rear 24*b* of frame 24. Both swing plates 232, 252 have extending shoulders 274, 276 respectively, that extend in the direction to the front 24*a* of frame 24. Accordingly, rotation of the swing gates 230, 250 toward the rear 24*b*, as shown by directional arrows 278, 280 in FIG. 9*a*, causes swing plates 232, 252 respectively also to rotate toward the rear 24*b*. Rotation of swing plates 232, 252 in this manner causes left clamp 234 and right clamp 254 to rotate as shown by directional arrows 282, 284 in FIG. 9, from a first position 286, essentially parallel to the direction of travel of ram 30, as shown in FIG. 9*a*, to a second position 288, oblique to the direction of travel of ram 30, or inward, toward each other, as shown in FIG. 9*b*.

Figure 11A:
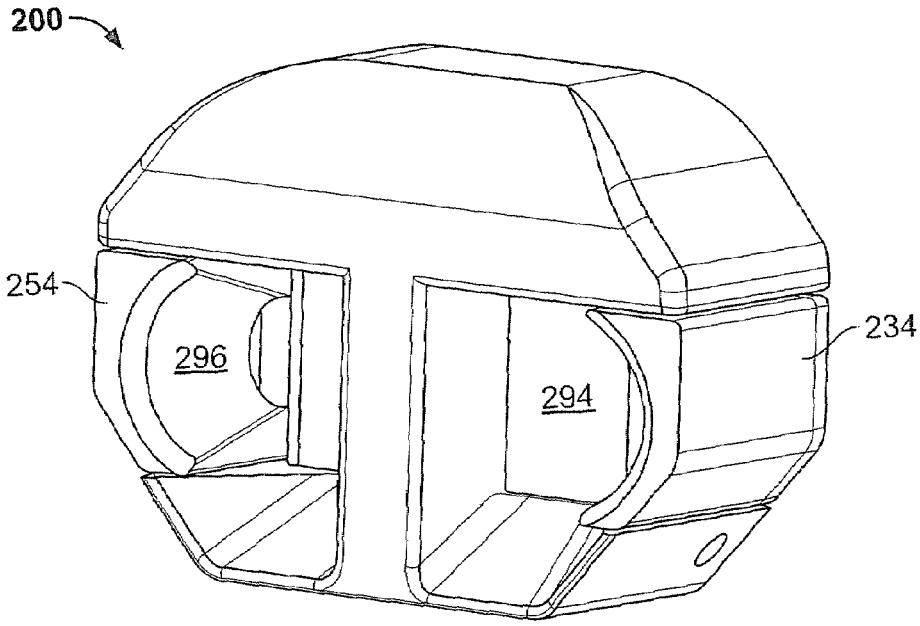
FIG. 11*a* is another perspective view of the pusher assembly of the preferred embodiment of the present invention, showing the components in a first, or open, position.

When the clamps 240, 260 are in their first positions 290, 292, as shown in, for example, FIG. 11*a*, two chambers 294, 296 are formed. Left chamber 294 is formed by base portion 216, connecting portion 218, top portion 220, and left clamp 234. Right chamber 296, in mirror image, is formed by base portion 216, connecting portion 218, top portion 220, and right clamp 254.

Preferably, left clamp 234 and right clamp 254 each have an arcuate inner surface, to facilitate grabbing the legs 204, 206 of a chicken, as will hereinafter be described.

Figure 10B:
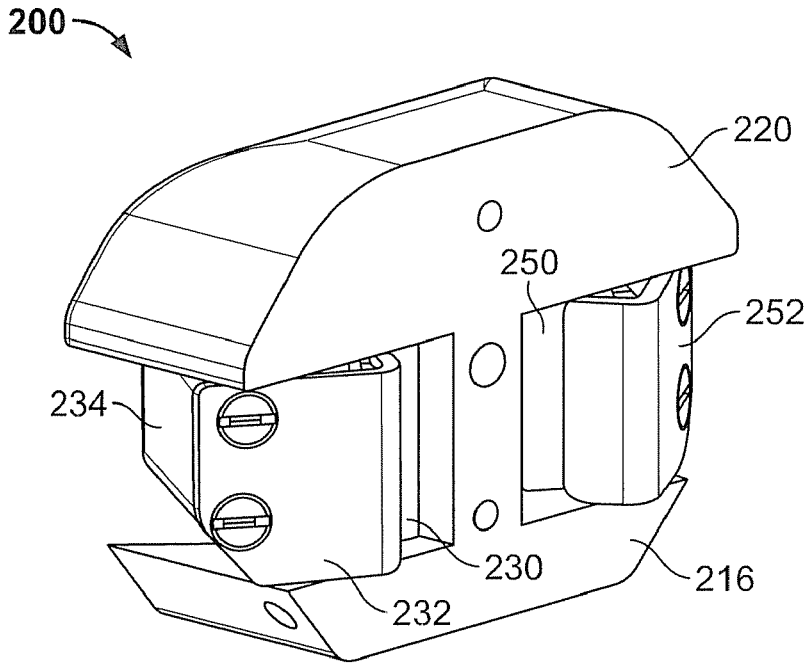
FIG. 10*b* is a perspective view of the pusher assembly of the preferred embodiment of the present invention, showing the components in a second, or closed, position.
Figure 11B:
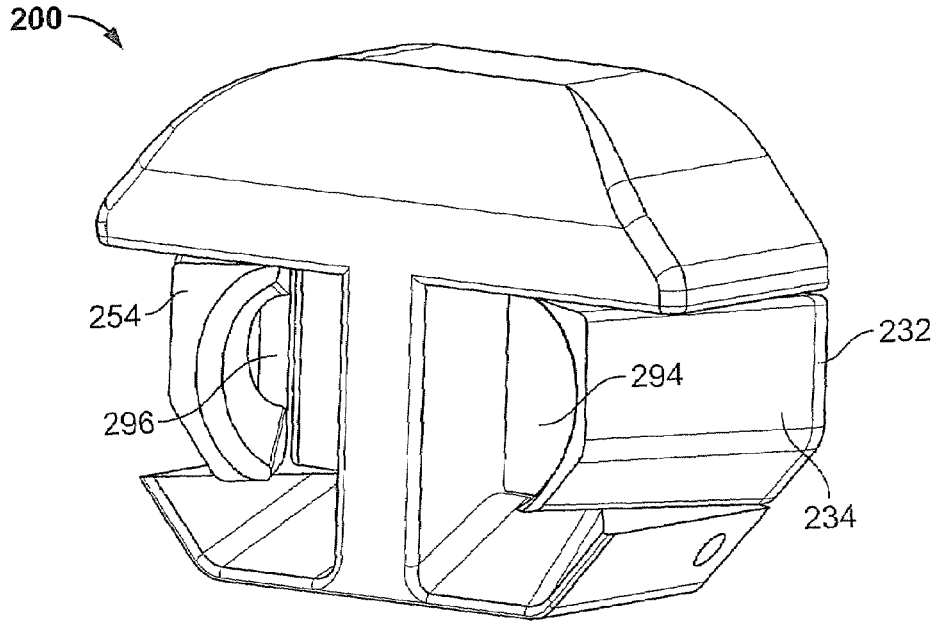
FIG. 11*b* is another perspective view of the pusher assembly of the preferred embodiment of the present invention, showing the components in a second, or closed, position.

As ram 30 and pusher assembly 200 make a forward stroke, pusher assembly 200 encounters a chicken 202 placed between guides 46, 48. Legs 204, 206 each enter left chamber 294 and right chamber 296, respectively, as shown in FIG. 9*a*. Continued forward movement of ram 30 causes swing gates 230, 250 to rotate about gate axle bolts 236, 256, respectively, as shown by directional arrows 278, 280. The rotation pushes shoulders 270, 272 against swing plates 232, 252, causing them also to rotate about plate axle bolts 238, 258, thereby causing clamps 240, 260 to rotate inward from their first position 286 to their second position 288, as shown in FIGS. 9*b*, 10*b*, and 11*b*. In this position, chambers 294, 296 are reduced in size from a larger, first size to a smaller, second size.

The rotation of clamps 234, 254 causes the arcuate inner surfaces to contact the legs 202, 204 of the chicken 200. The clamps 234, 254 thereby grasp legs 204, 206, holding them in a proper hocking position. As ram 30 continues its forward stroke, the chicken 202 is pushed into bag 32A as described above. When the chicken 202 is completely in the bag and ram 30 begins its reverse stroke, the pressure of legs 204, 206 against swing gates 230, 250 is relieved.

Figure 10A:
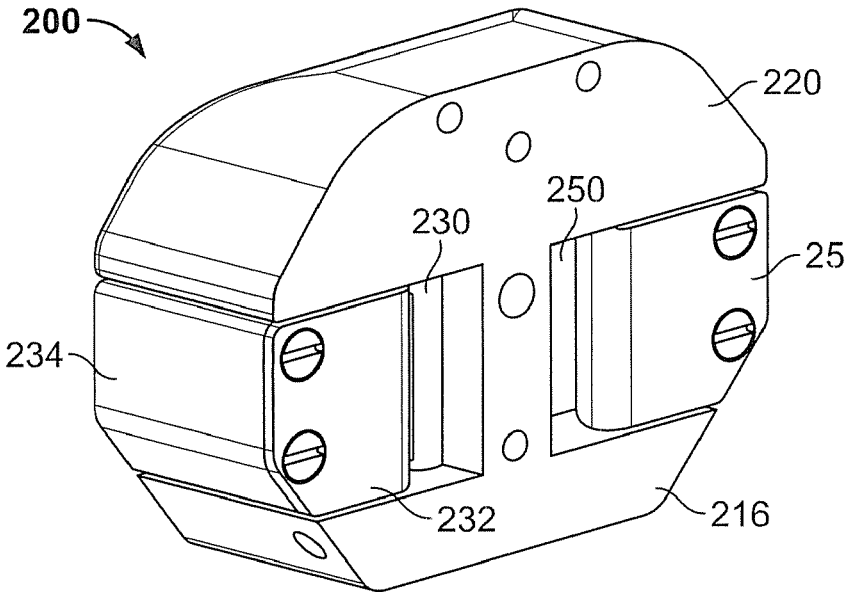
FIG. 10*a* is a perspective view of the pusher assembly of the preferred embodiment of the present invention, showing the components in a first, or open, position.

Swing plates 232, 252 are biased toward their first positions, as shown in FIGS. 9*a*, 10*a*, and 11*a*. Accordingly, when the legs 204, 206 are no longer pressing against swing gates 230, 250, swing plates 232, 252 return to their first positions, bringing clamps 234, 254 also to their first positions as shown in FIGS. 9*a*, 10*a*, and 11*a*, allowing swing plates 232, 252 and clamps 234, 254 to return to their first position, and rotating swing gates 230, 250 back to their first position. The The legs 204, 206 therefore can slide out of chambers 294, 296, leaving chicken 202 in bag 30A as described above.

While preferred embodiments of the present invention are shown and described, it is envisioned that those skilled in the art may devise various modifications of the present invention without departing from the spirit and scope of the appended claims.

The invention claimed is:

1. A apparatus for packaging a poultry in a bag, comprising:

a frame having a left side and a right side;

a left base guide projecting from said left side of said frame, said left base guide comprising a base element and a side element, said base element and said side element forming an angle greater than 90 degrees;

a right base guide projecting from said right side of said frame, said right base guide comprising a base element and a side element, said base element and said side element forming an angle greater than 90 degrees;

a right finger attached to said frame and rotating in an arc from a first position between said left base guide and said right base guide, to a second position above said right base guide;

a left finger attached to said frame and rotating in an arc from a first position between said left base guide and said right base guide, to a second position above said left base guide;

whereby rotation of said right finger from said right finger first position to said right finger second position and rotation of said left finger from said left finger first position to said left finger second position, stretches a bag placed over said left base guide, said right base guide, said left finger, and said right finger, to form a cross-section of a hexagon;

a pusher assembly comprising a body having a first chamber and a second chamber said pusher assembly mounted on a ram, said ram moving from a first position remote from said base guides, to a second position adjacent said base guides, said first chamber grasping a first leg of a poultry placed between said base guides and said second chamber grasping a second leg of the poultry;

whereby said pusher assembly maintains the first leg and the second leg in a hocked position as said ram guides the poultry into the stretched bag.

2. The apparatus of claim 1, wherein said body further comprises:

a first clamp defining said first chamber, said first clamp rotatable from a first position defining a first size of said first chamber to a second position defining a second size of said second chamber, said first size selected to allow entry of the first leg into said first chamber and said second size selected to grasp the first leg; and a second clamp defining said second chamber, said second clamp rotatable from a first position defining a first size of said second chamber to a second position defining a second size of said second chamber, said first size selected to allow entry of the second leg into said second chamber and said second size selected to grasp the second leg.

3. The apparatus of claim 2, further comprising:

a first swing gate rotatable about an axle and in contact with said first clamp, whereby a forward stroke of said ram pushes the first leg against said first swing gate to rotate said first clamp from said first position to said second position; and a second swing gate rotatable about an axle and in contact with said second clamp, whereby a forward stroke of said ram pushes the second leg against said second swing gate to rotate said second clamp from said first position to said second position.

4. The apparatus of claim 3, wherein said first swing gate and said second swing gate are biased to said first position.

5. A method for packaging poultry in a bag, comprising:

placing a bag, said bag having a relaxed state, a tightly stretched state, and an intermediate stretched state, over a right base guide, a left base guide, a right finger, and a left finger, while said bag is in said relaxed state, said left base guide comprising a base element and a side element, said base element and said side element forming an angle greater than 90 degrees, said right base guide comprising a base element and a side element, said base element and said side element forming an angle greater than 90 degrees, and said left base guide and said right base guide being oriented a distance apart;

rotating said right finger in an arc from a first position between said left base guide and said right base guide, to a second position above said right base guide;

rotating said left finger in an arc from a first position between said left base guide and said right base guide, to a second position above said left base guide;

whereby rotation of said right finger from said right finger first position to said right finger second position and rotation of said left finger from said left finger first position to said left finger second position, stretches said bag over said left base guide, said right base guide, said left finger, and said right finger, to form a cross-section of a hexagon;

providing a pusher assembly having a body and first chamber and a second chamber within said body, said first chamber and said second chamber configured to grasp a leg of a poulty; and grasping a first leg and a second leg of the poultry and guiding the poultry into said bag in said tightly stretched state.

* * * * *